US005090311A

United States Patent [19]

Brasa

[11] Patent Number: 5,090,311

[45] Date of Patent: Feb. 25, 1992

[54] MACHINE FOR SILK-SCREEN PRINTING, IN PARTICULAR FOR MULTI-COLOR PRINTING

[75] Inventor: Umberto Brasa, Milan, Italy

[73] Assignee: COMEC S.r.l., Italy

[21] Appl. No.: 520,835

[22] Filed: May 10, 1990

Related U.S. Application Data

[63] Continuation of Ser. No. 338,115, Apr. 14, 1989, abandoned.

[30] Foreign Application Priority Data

May 2, 1988 [IT] Italy ..... 20409 A/88

[51] Int. Cl.[5] ..... B41F 15/10; B41F 15/12

[52] U.S. Cl. ..... 101/115; 101/488

[58] Field of Search ..... 101/115, 126, 488

[56] References Cited

U.S. PATENT DOCUMENTS

| | | | |
|---|---|---|---|
| 2,846,946 | 8/1958 | Schwarzberger | 101/115 |
| 3,040,657 | 6/1962 | Ichinose | 101/115 |
| 3,137,230 | 6/1964 | Ichinose | 101/115 |
| 3,751,204 | 8/1973 | Baker | 101/123 X |
| 4,407,195 | 10/1983 | Jaffa | 101/126 X |
| 4,649,815 | 3/1987 | Richardson | 101/126 |

*Primary Examiner*—Clifford D. Crowder

*Attorney, Agent, or Firm*—Venable, Baetjer and Howard

[57] ABSTRACT

A machine for silk-screen printing, in particular for multi-color printing, comprises a plurality of support tables for supporting an article to be printed, which are intermittently sliding and can be positioned in correspondence to fixed stations; the machine comprises furthermore a plurality of printing heads which can be associated with the framework of the machine in such a way as to be interchangeable at any one of the fixed stations.

9 Claims, 1 Drawing Sheet

MACHINE FOR SILK-SCREEN PRINTING, IN PARTICULAR FOR MULTI-COLOR PRINTING

This application is a continuation of application Ser. No. 338,115, filed Apr. 14, 1989, now abandoned.

The present invention relates to a machine for silk-screen printing, in particular for multi-colour printing.

Machines for multi-colour silk-screen printing are known in the art. Such machines comprises a plurality of tables or supporting pallets sliding along an oval path having a plurality of fixed stations. Each one of said fixed stations comprises a printing head or a drying head or, optionally, a cooling head, arranged according to a predetermined sequence depending on the type of printing to be carried out and on the number of the colours.

These machines have been widely adopted and have reached a high degree of operating precision and reliability. This is true, in particular, for those machines which use one single motor with one drive shaft for a plurality of printing heads.

Unfortunately, these machines have the disadvantage that they are suitable for carrying out one single type of printing only. Their sequence of printing operations cannot be modified because the arrangement of the printing heads, drying heads, and possible cooling heads is fixed and determined at the design time.

The main task to the present invention is of provide a machine for silk-screen printing, in particular for multi-colour printing, whereby it is possible to change the sequence of operations so as to change the capabilities and results of silk-screen printing which one desires to obtain.

Within the scope of said task, a purpose of the present invention is of providing a machine whereby it is possible to change the printing sequence in a simple and rapid way, and with a range of changes which is as wide as possible.

Another purpose of the invention is of providing a machine which has a simple and reliable mechanical structure, and which, moreover, does not increase the overall cost of the machine.

This task, as well as these and still other purposes, which will become from the following, are achieved by a silk-screen printing machine, in particular for multi-colour silk-screen printing, which comprises a plurality of support tables or pallets for supporting an article to be printed, wherein said support pallets are intermittently slidable and are capable of being positioned in correspondence to fixed stations, characterized in that said machine further comprises a plurality of printing heads which can be interchangeably positioned at said fixed stations.

Further characteristics and advantages of the present invention will become more evident from the following disclosure of a preferred, non-exclusive form of practical embodiment of the machine according to the invention, illustrated for exemplifying, non-limitative purposes in the hereto attached drawings, in which.

Figure 1:
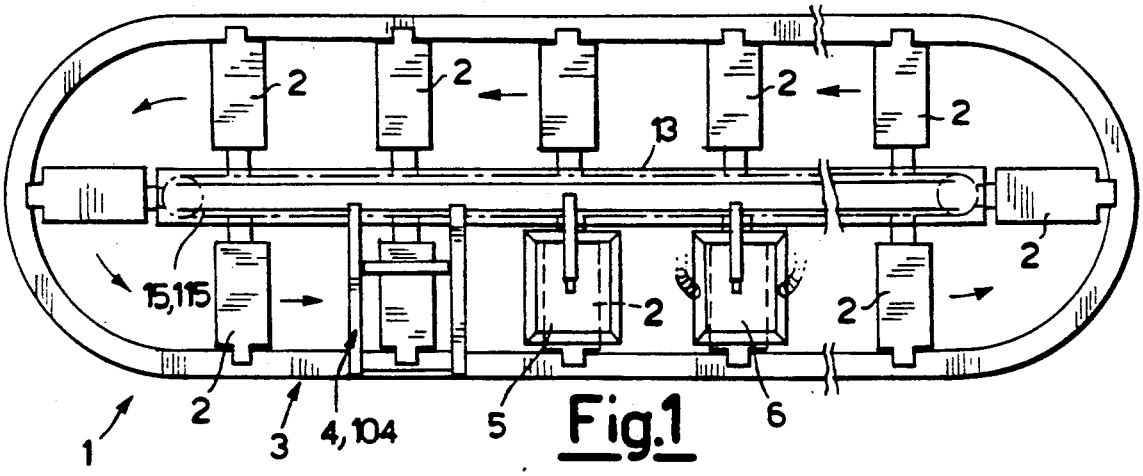
FIG. 1 shows a schematic plan view of a machine for multi-colour silk-screen printing according to the present invention.
Figure 2:
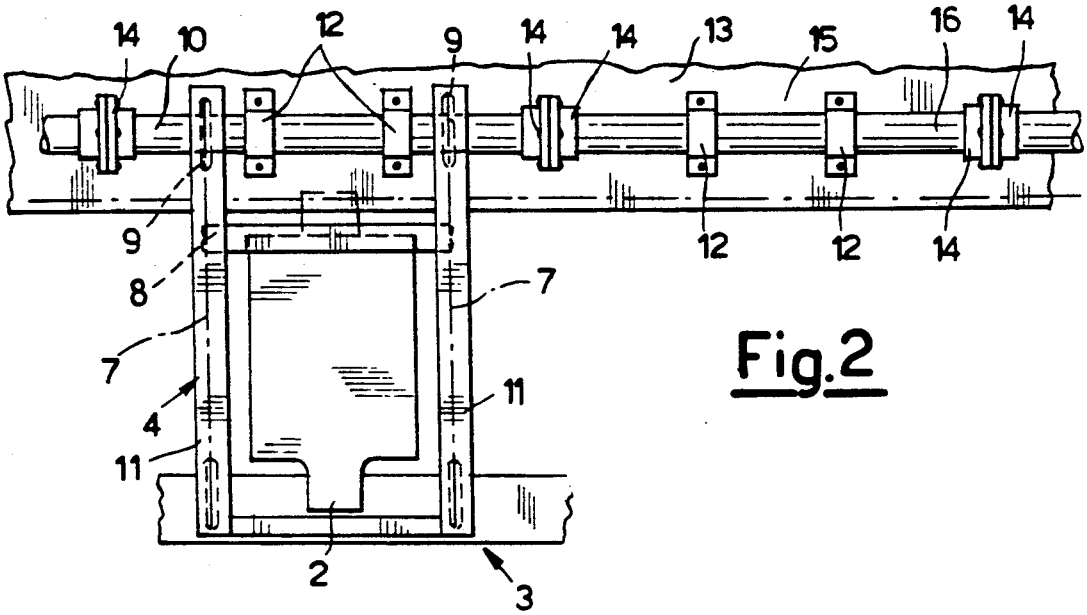
FIG. 2 shows a schematic plan view, on an enlarged scale, of a printing head applied to the drive shaft of the machine.

Referring to the above cited figures, the machine for silk-screen printing, generally indicated by the reference numeral 1, comprises a plurality of pallets 2 for supporting garments positioned thereon to be printed that are intermittently slidable along an oval path, in a known way. The tables 2 can be positioned in correspondence to fixed stations 3, at which the printing heads 4, or drying heads 5, or also cooling heads 6 can be installed.

A printing head 4 comprises a pair of chains 7 which drive a doctor-carrier bar 8 in a known way. The chains 7 are driven by sprocket wheels 9 which, according to the prior art, are keyed on a drive shaft driven by a motor and integral with the framework or support chassis of the machine.

According to a first aspect of the present invention, the sprocket wheels 9 are keyed onto an element of transmission shaft 10 supported by the bars 11 which constitute side support elements for the printing head 4. The element of transmission shaft 10 is supported by support bearings 12 removably associable with the support chassis 13 of the printing machine.

Each end of the element of transmission shaft 10 is provided with a flanged sleeve 14 slidable and lockable on the transmission shaft 10.

The drive shaft 15 which drives the printing heads 4 is constituted by a plurality of shaft elements 16, with each one of said shaft elements being positioned in correspondence to each one of said fixed stations 3. The shaft element 16 is removably associable with the support chassis 13 of the machine by means of the support bearings 12 and each one of its ends is provided with a flanged sleeve 14 associable with a sleeve 14 of an adjacent shaft element 16, or of a transmission shaft element 10 of an adjacent printing head.

Of course, at one of its ends, the drive shaft 15 is obviously connected with a motor means in a known way.

The interchangeability of the printing heads 4 at the various fixed stations 3 is achieved in the following way: when one desires to apply a printing head 4 in correspondence to an empty fixed station 3, the support bearings 12 are dismantled and one shaft element 16 is removed after disengaging the flanged sleeves 14 from the adjacent sleeves 14 of the adjacent elements.

The transmission shaft element 10 of a printing head 4 is then replaced for the shaft element 16, by fastening the support bearings 12 onto the support chassis 13, and locking the flanged sleeves 14 onto the corresponding adjacent flanged sleeves.

Each fixed station 3 additionally comprises support means (not shown for the sake of simplicity) for the drying heads 5 or the cooling heads 6, which do not require to be linked to the drive shaft 15.

Figure 3:
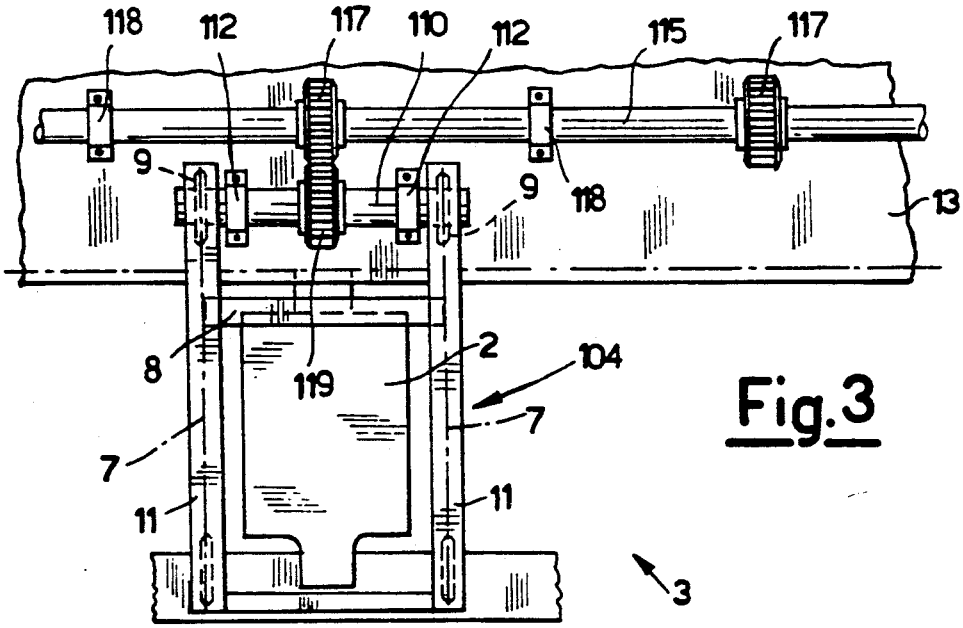
FIG. 3 shows a schematic plan view, on an enlarged scale, of a printing head applied t the drive shaft of the machine according to another aspect of the invention.

In FIG. 3, a further system is shown, which makes it possible to interchange printing heads 104 in the machine according to the invention.

In this case, the drive shaft 115 is constituted by one single piece, and is provided, in correspondence to each one of the fixed stations 3, with a drive gear wheel 117, as well as with a plurality of fastening bearings 118, which enable it to be fastened to the support chassis 13 of the printing machine.

Each printing head 104 comprises a transmission shaft 110 equipped with support bearings 112 which can be removably associated with the framework 13 of the printing machine. In an analogous way as hereinabove specified, the shaft 110 is rotatably supported by the bars 11 of the printing head 104 and is equipped with sprocket wheels 9 for driving the chains 7.

The transmission shaft 110 furthermore comprises a transmission gear wheel 119 which enmeshes with the drive gear wheel 117 of the drive shaft 115 in order to accomplish kinematic coupling between the same shaft 115 and the transmission shaft 110 of the printing head.

Of course, each drive gear wheel 117 can engage two transmission gear wheels 119 corresponding to two printing heads 104 positioned at opposite sides of the machines.

As clearly seen, each head 104 is interchangeable at the various fixed stations 103 by simply dismantling the support bearings 112 from, and mounting said bearings again on, the machine support chassis 13.

In this case too, each fixed station 3 is provided with support means for supporting the drying heads 5, or the possible cooling heads 6 in a known way.

In practice, the present Applicant was able to observe that the machine according to the present invention is capable of fully fulfilling the previously mentioned task by asking the interchangeability of the position of the various printing heads, drying heads, or cooling heads, in a simple way possible and within a wide range of variability.

A further advantage of the present invention is that a machine is provided which is structurally simple, assures absolute operating precision, has reduced maintenance requirements.

The so conceived machine can be supplied with a large number of modifications and variation, all of them being within the purview of the inventive concept, and furthermore all of the details thereof may be replaced by technically equivalent elements.

The materials used, as well as the dimensions, can be any materials and dimensions, according to the requirements and the state of the art.

I claim:

1. A silk-screen printing machine comprising:

a structural support chassis;

a track connected to said support chassis, said track having a plurality of fixed stations;

a plurality of support pallets for supporting articles to be printed by the machine, said support pallets being intermittently slidable along said track such that they are positionable proximate said fixed stations;

a plurality of interchangeably mountable heads operable during the printing of the articles supported on said tables, said heads being interchangeably mounted to said support chassis proximate said fixed stations;

at least one drive shaft connected to said support chassis for supplying driving power to at least one of said heads mounted to said frame, said at least one drive shaft comprising a plurality of interconnected shaft elements, each on of said plurality of heads including transmission means comprising a shaft element for transmitting power from said drive shaft to the head; and a plurality of support bearings associable with said support chassis for removably securing said shaft elements to said support chassis, whereby at least one of said heads is removably mounted to said support chassis by removing a shaft element of said drive shaft and replacing it with the shaft element of a replacement head to be mounted to said support chassis.

2. A machine according to claim 1, wherein said shaft elements are provided at their respective ends with a flanged sleeve attachable to a corresponding flanged sleeve on an adjacent shaft element to form a coupling between the shaft elements.

3. A machine according to claim 1, wherein said plurality of heads includes a plurality of printing heads, each of said printing heads having a doctor-carrier bar that is selectively displaceable upon receipt of driving input from said drive shaft through said transmission means.

4. A silk-screen printing machine comprising:

a structural support chassis;

a track connected to said support chassis, said track having a plurality of fixed stations;

a plurality of support pallets for supporting articles to be printed by the machine, said support pallets being intermittently slidable along said track such that they are positionable proximate said fixed stations;

a plurality of interchangeably mountable heads operable during the printing of the articles supported on said pallets, said heads being interchangeably mounted to said support chassis proximate said fixed stations;

at least one drive shaft connected to said support chassis for supplying driving power to at least one of said heads mounted to said support chassis, said at least one drive shaft being equipped with at least one gear wheel proximate at least one of said fixed stations, wherein each of said plurality of heads includes transmission means for transmitting driving power from said drive shaft to the head, said transmission means further including a transmission shaft having a transmission gear wheel engageable with said at least one gear wheel such that the driving power from the drive shaft is transmitted to said at least one head; and support bearings associable with said support chassis for removably securing said transmission shaft to said support chassis, whereby at least one of said heads is removably mounted to said support chassis by removably securing said transmission shaft to said support chassis by said support bearings such that said transmission gear wheel engages at least one drive gear wheel.

5. A machine according to claim 4, wherein said plurality of heads includes a plurality of printing heads each having a doctor-carrier bar that is selectively displaceable upon receipt of driving input from said drive shaft through said transmission means.

6. A silk-screen printing machine, comprising:

a structural support chassis;

a track connected to said support chassis, said track having a plurality of fixed stations;

a plurality of support pallets for supporting articles to be printed by the machine, said support pallets being intermittently slidable along said track such that the support pallets are positionable proximate said fixed stations;

a plurality of heads mountable to said support chassis;

a drive shaft connected to said support chassis for supplying driving power to at least one of said heads mounted thereto;

means for removably and interchangeably mounting said heads to said support chassis proximate to said fixed stations that includes transmission means attached to the head for transmitting power from said drive shaft to the head;

said drive shaft comprising a plurality of interconnected individual shaft elements;

said transmission means including an individual shaft element; and said means for removably mounting and interchanging the heads further comprising a plurality of support bearings for removably securing said individual shaft elements to said, whereby at least one of the heads removably mounted to said support chassis is detachable from the support chassis by removing an individual shaft element of said drive shaft and replacing it with the individual shaft element of the transmission means attached to the head to be mounted in place of the head detached from the support chassis.

7. A machine according to claim 6, wherein said individual shaft elements are provided at their respective ends with a flanged sleeve attachable to a corresponding flanged sleeve on an adjacent individual shaft element to form a coupling between the individual shaft elements.

8. A silk-screen printing machine, comprising:

a structural support chassis;

a track connected to said support chassis, said track having a plurality of fixed stations;

a plurality of support pallets for supporting articles to be printed by the machine, said support pallets being intermittently slidable along said track such that they are positionable proximate said fixed stations;

a plurality of heads mountable to said support chassis;

a drive shaft connected to said support chassis for supplying driving power to at least one of said heads mounted thereto;

means for removably and interchangeably mounting said heads to said support chassis proximate to said fixed stations that includes transmission means attached to the head for transmitting power from said drive shaft to the head; comprising said drive shaft comprising at least one drive gear wheel proximate at least one of said fixed stations; and said transmission means comprising a transmission gear wheel engageable with said at least one drive gear wheel such that said driving power is transmitted from the drive shaft to the head proximate to the fixed station.

9. A machine according to claim 8, wherein:

said transmission means includes a transmission shaft on which said transmission gear wheel is attached; and said means for removably mounting and interchanging said heads includes support bearings for removably securing said transmission shaft to said support chassis, whereby at least one of the heads is removably mounted to said support chassis by removably securing said transmission shaft thereto by said support bearings such that said transmission gear wheel engages said at least one drive gear wheel.

* * * * *